US006209992B1

(12) United States Patent
Hashizume

(10) Patent No.: US 6,209,992 B1
(45) **Date of Patent: *Apr. 3, 2001**

(54) INK-JET RECORDING HEAD, INK-JET RECORDING APPARATUS USING THE SAME, AND METHOD FOR PRODUCING INK-JET RECORDING HEAD

(75) Inventor: Tsutomu Hashizume, Nagano (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/803,855

(22) Filed: Feb. 21, 1997

(30) Foreign Application Priority Data

Feb. 22, 1996 (JP) ..... 8-035252
Apr. 5, 1996 (JP) ..... 8-083645

(51) Int. Cl.[7] ..... B41J 2/05
(52) U.S. Cl. ..... 347/65; 347/68
(58) Field of Search ..... 347/68, 71, 72; 310/363, 364; 216/27

(56) References Cited

U.S. PATENT DOCUMENTS 4,922,265 * 5/1990 Pan ..... 347/68
5,446,484 8/1995 Hoisington et al. ..... 347/68
5,691,752 * 11/1997 Moynihan et al. ..... 347/68
5,773,911 * 6/1998 Tanaka et al. ..... 310/313 B
5,988,800 * 11/1999 Ema et al. ..... 347/70

FOREIGN PATENT DOCUMENTS 0 408 306 1/1991 (EP) .
WO 93/22140 11/1993 (EP) .
0 587 346 3/1994 (EP) .
0 786 345 1/1997 (EP) .
3-124449 * 5/1991 (JP) .
4-184985 * 7/1992 (JP) .
5-50596 * 3/1993 (JP) .
5-504740 7/1993 (JP) ..... B41J/2/16

OTHER PUBLICATIONS

Kenji Iijima, Ichiro Ueda and Koichi Kugimiya, "Preparation and Properties of Lead Zirconate–Titanate Thin Films", Jul. 20, 1991, pp. 2149–2151.

* cited by examiner

*Primary Examiner*—David F. Yockey
*Assistant Examiner*—Michael S. Brooke
(74) *Attorney, Agent, or Firm*—Sughrue, Mion, Zinn, Macpeak & Seas, PLLC

(57) ABSTRACT

An ink-jet recording head includes: a substrate having a first main surface and a second main surface; ink cavity chambers formed on the second main surface of the substrate; and a piezoelectric element device formed on the first main surface of the substrate, the piezoelectric element including a first electrode, a piezoelectric thin film and a second electrode stacked in this order. A material of the first electrode is the same as that of the second electrode in electrochemical potential.

7 Claims, 18 Drawing Sheets

INK-JET RECORDING HEAD, INK-JET RECORDING APPARATUS USING THE SAME, AND METHOD FOR PRODUCING INK-JET RECORDING HEAD

BACKGROUND OF THE INVENTION

The present invention relates to an ink-jet recording head using a piezoelectric thin film as a driving source for ink discharge, an ink-jet recording apparatus provided with this ink-jet recording head, such as an ink-jet printer used as an output equipment of a personal computer, a facsimile or a word processor, and a method for producing an ink-jet recording head. More particularly, it relates to an improvement in an electrode forming technique.

There is a piezoelectric type ink-jet recording head using piezoelectric elements formed of lead zirconate titanate as electromechanical transducer elements, driving sources for liquid or ink discharge. This recording head generally comprises a head base on which a large number of separate ink passages are formed, a diaphragm attached to the head base so as to cover all of the separate ink passages, and piezoelectric elements deposited onto respective parts on the diaphragm corresponding to the separate ink passages. An electric field is applied to the piezoelectric element to displace it, thereby pushing out ink existing in the separate ink passage through a nozzle of the separate ink passage.

As one example, International Patent Application Laid-open In Japan No. Hei. 5-504740 is present. Then, a method for producing an ink-jet recording head described in this publication will be illustrated with reference to the drawings.

As shown in FIG. 35, a silicon oxide film SID is formed on a silicon substrate SI, and a conductive layer FMF formed of a platinum, aluminum or nickel thin film as a lower electrode is formed thereon. Then, as shown in FIG. 36, a resist area DRS exposed to light photolithography is formed on the conductive layer, and as shown in FIG. 37, an electrode pattern FML is formed by using this resist area DRS exposed to light as a mask.

Next, as shown in FIG. 38, lead zirconate titanate PEZ which is a kind of piezoelectric thin film is further formed by the sol-gel method, and subsequently, a second metal thin film SMF as an upper electrode is deposited so as to cover lead zirconate titanate PEZ. Further, a resist RS is formed so as to cover the second metal thin film SMF.

Then, a resist area DRS exposed to light is formed so that a second electrode pattern is obtained by irradiating ultraviolet light rays through a mask MSK.

Further, as shown in FIG. 39, after formation of the second electrode pattern SML, a protective film PSV is deposited onto it. Furthermore, as shown in FIG. 39, a resist is deposited onto a second main surface of the silicon substrate, and then as shown in FIG. 40, ultraviolet light rays are irradiated through a mask MSK to form a resist area DRS exposed to light.

Then, as shown in FIG. 41, the resist is separated so as to leave the resist area DRS exposed to light, and the silicon substrate SI is subjected to anisotropic etching in a strong alkaline solution. The resist area DRS exposed to light is further separated to form ink cavity chambers CAV.

However, in the method for producing the ink-jet recording head described above, no consideration is given to formation of the first and second electrode patterns FML and SML, and the ink cavity chambers CAV at an exact position without deviation from each other. Then, in order to form the electrode patterns and the ink cavity chambers at an exactly adjusted position, photolithography with a both side exposure device is applied to the method described above.

However, patterning of the electrode of the ink-jet recording head by the photolithography method introduce the problem that the electrode is electrolytically corroded with the developing solution used when the resist exposed to light is developed, resulting in failure to form the electrode pattern.

That is, when the first electrode pattern is made of platinum and the second electrode pattern is made of a material different therefrom, and when a positive resist for photolithography is selected from the viewpoints of low cost and improved patterning accuracy for patterning of the electrode and protection of the electrode, the electrolytic corrosion phenomenon occurs between platinum and the second metal thin film due to the difference in electrochemical potential, because the developing solution for the positive resist is an alkaline electrolytic solution.

For example, when the first electrode pattern LE is platinum and the second electrode pattern is aluminum, the phenomenon occurs that hydrogen gas is produced from platinum of the first electrode to dissolve or separate aluminum of the second electrode. This electrolytic corrosion phenomenon introduces the problems that poor formation of the electrode pattern takes place in the ink-jet recording head, and further, that no piezoelectric element can be formed.

It is therefore an object of the present invention to provide an ink-jet recording head not having poor formation of an electrode pattern caused by such an electrolytic corrosion phenomenon, and an ink-jet recording apparatus provided with the same. Further, another object of the present invention is to provide a method by which it can be produced without generation of the above-mentioned electrolytic corrosion phenomenon.

On the other hand, in order to discharge a large amount of ink from a ink-jet head, it is desirable that a diaphragm is largely displaced. For this purpose, for example, a platinum thin plate having a higher Young's modulus is used as the first metal thin film, and a metal thin film having a lower Young's modulus is used as the second metal thin film. An aluminum thin film has a very low Young's modulus. Accordingly, when a voltage is applied to a piezoelectric element device, it is displaced twice or more compared with the case that the first and second metal thin films are both made of platinum.

However, when the electrochemical potential of the second metal thin film is base to that of the first metal thin film, there is the problem that the above-mentioned electrolytic corrosion phenomenon takes place in patterning the second metal thin film by photolithography, resulting in failure to obtain a good pattern of the second metal thin film.

SUMMARY OF THE INVENTION

Then, an object of the present invention is to provide an ink-jet recording head which can attain the above-mentioned object while attaining large displacement of a diaphragm, an ink-jet recording apparatus and a manufacturing method thereof.

In order to attain the above-mentioned objects, the present inventors have conducted intensive investigation. As a result, in manufacturing processes of ink-jet recording heads, the finding has been obtained that conventional poor formation of electrodes can be avoided by selecting for upper and lower electrodes such compositions that no electrolytic corrosion takes place even when positive resists are used for pattern formation of the electrodes or protection thereof and the electrodes are exposed to developing solutions for the positive resist, even if the upper electrode and the lower electrode are in conduction.

On the other hand, in the manufacturing course of the ink-jet recording heads, generation of electrolytic corrosion in the electrodes can be avoided, even if the electrodes are exposed to the developing solutions for the positive resists, and the desired compositions can be selected for the upper and lower electrodes, by keeping the upper and lower electrodes in the nonconducting state. Further, the use of negative resists for pattern formation of the electrodes or protection thereof instead of the positive resists can also prevent generation of electrolytic corrosion and select the desired compositions for the electrodes.

The present invention is characterized by a novel ink-jet recording head obtained based on such findings, and a method for producing the same.

An ink-jet recording head according to the present invention comprises a piezoelectric element device formed on a first main surface of a substrate and ink cavity chambers formed on a second main surface, the piezoelectric element device being formed by stacking a first electrode, a piezoelectric thin film and a second electrode in this order, wherein a material of the first electrode is the same as that of the second electrode in electrochemical potential. More preferably, the first and second electrodes are both formed of platinum.

Further, an ink-jet recording head according to the present invention comprises a piezoelectric element device formed on a first main surface of a substrate and ink cavity chambers formed on a second main surface, the piezoelectric element device being formed by stacking a first electrode, a piezoelectric thin film and a second electrode in this order, wherein the electrochemical potential of a material of the first electrode and that of a material of the second electrode are within a range in which no electrolytic corrosion is developed between both electrodes to a developing solution for a resist used in forming at least one of the first and second electrodes. Preferably, the electrochemical potential of the first electrode and that of the second electrode are within a range in which no electrolytic corrosion is developed to an alkaline electrolytic solution used for development of a positive resist.

Furthermore, another ink-jet recording head according to the present invention comprises a piezoelectric element device formed on a first main surface of a substrate and ink cavity chambers formed on a second main surface, the piezoelectric element device being formed by stacking a first electrode, a piezoelectric thin film and a second electrode in this order, wherein the first and second electrodes are each formed of metals different from each other in electrochemical potential, and patterns of these electrodes are formed by use of a negative resist utilizing no electrolytic solution as a developing solution.

Further, a method for producing an ink-jet recording head according to the present invention comprises the steps of forming a piezoelectric element device on a first main surface of a substrate, and forming ink cavity chambers on a second main surface, the piezoelectric element device being formed by stacking a first electrode, a piezoelectric thin film and a second electrode on the substrate in this order, and the electrodes and ink cavity chambers being formed by use of a resist so as to give specified patterns, wherein the first and second electrodes are each formed of metals different from each other in electrochemical potential, and a negative resist is utilized for formation of at least one of the patterns of the first and second electrodes so as to prevent the first and second electrodes from being directly exposed to a developing solution for a positive resist.

Furthermore, another method for producing an ink-jet recording head according to the present invention comprises the steps of forming a piezoelectric element device on a first main surface of a substrate, and forming ink cavity chambers on a second main surface, the piezoelectric element device being formed by stacking a first electrode, a piezoelectric thin film and a second electrode on the substrate in this order, and at least one of these electrodes and ink cavity chambers being patterned by use of a photoresist, wherein the first and second electrodes are stacked on the substrate so as not to be rendered conductive to each other during the course of the patterning. In a preferred embodiment, the second electrode is formed smaller than the piezoelectric thin film.

A further method for producing an ink-jet recording head according to the present invention comprises the steps of forming a piezoelectric element device on a first main surface of a substrate, and forming ink cavity chambers on a second main surface, the piezoelectric element device being formed by stacking a first electrode, a piezoelectric thin film and a second electrode on the substrate in this order, and the electrodes and ink cavity chambers being formed by use of a resist so as to give specified patterns, wherein the first and second electrodes are each formed of materials identical to each other in electrochemical potential. Preferably, the first and second electrodes are formed of the same material. More preferably, the first and second electrodes are both formed of platinum.

According to one embodiment of the invention, a method for producing an ink-jet recording head comprises the steps of forming oxide films on both surfaces of a silicon substrate, depositing a first metal thin film onto the oxide film on the first main surface of the silicon substrate, depositing a piezoelectric thin film onto the first metal thin film, forming a second metal thin film made of a material which is the same as that of the first metal thin film on the piezoelectric thin film, depositing a positive resist film onto the oxide film of the second main surface of the silicon substrate, the second main surface having no first metal thin film thereon, depositing a negative resist film onto the second metal thin film, disposing the silicon substrate between aligned first and second masks for photolithography so that the first mask and the first main surface of the silicon substrate face each other, irradiating both surfaces of the silicon substrate with light so that the surfaces are exposed to light in patterns of the first and second masks, developing the positive resist exposed to light with an alkaline solvent for patterning, developing the negative resist exposed to light with an organic solvent for patterning, depositing a positive resist onto the whole surface of the first main surface, etching the oxide film formed on the second main surface with an acidic solution by using the patterned positive resist as a mask, separating the positive resist deposited onto the whole surface of the first main surface, and etching the second metal thin film formed on the first main surface by using the patterned negative resist as a mask.

According to another embodiment of the invention, a method for producing an ink-jet recording head comprises the steps of forming oxide films on both surfaces of a silicon substrate, forming and attached a first metal thin film onto the oxide film on the first main surface of the silicon substrate, depositing a piezoelectric thin film onto the first metal thin film, forming a second metal thin film made of a material different from that of the first metal thin film on the piezoelectric thin film, depositing a positive resist film onto the oxide film of the second main surface of the silicon substrate, the second main surface having no first metal thin film thereon, depositing a first negative resist film onto the second metal thin film, disposing the silicon substrate between aligned first and second masks for photolithography so that the first mask and the first main surface of the silicon substrate face each other, irradiating both surfaces of the silicon substrate with light so that the surfaces are exposed to light in patterns of the first and second masks, developing the positive photoresist exposed to light with an alkaline solvent for patterning, developing the first negative photoresist exposed to light with an organic solvent for patterning, depositing a second negative photoresist onto the whole surface of the first main surface, etching the oxide film formed on the second main surface with an acidic solution by using the patterned positive photoresist as a mask, separating the second negative photoresist deposited onto the whole surface of the first main surface, and etching the second metal thin film formed on the first main surface by using the patterned first negative photoresist as a mask.

In addition, the present invention provides an ink-jet recording apparatus provided with the above-mentioned ink-jet recording head.

DETAILED DESCRIPTION OF THE PREFERRED EMBODIMENTS

Figure 42:
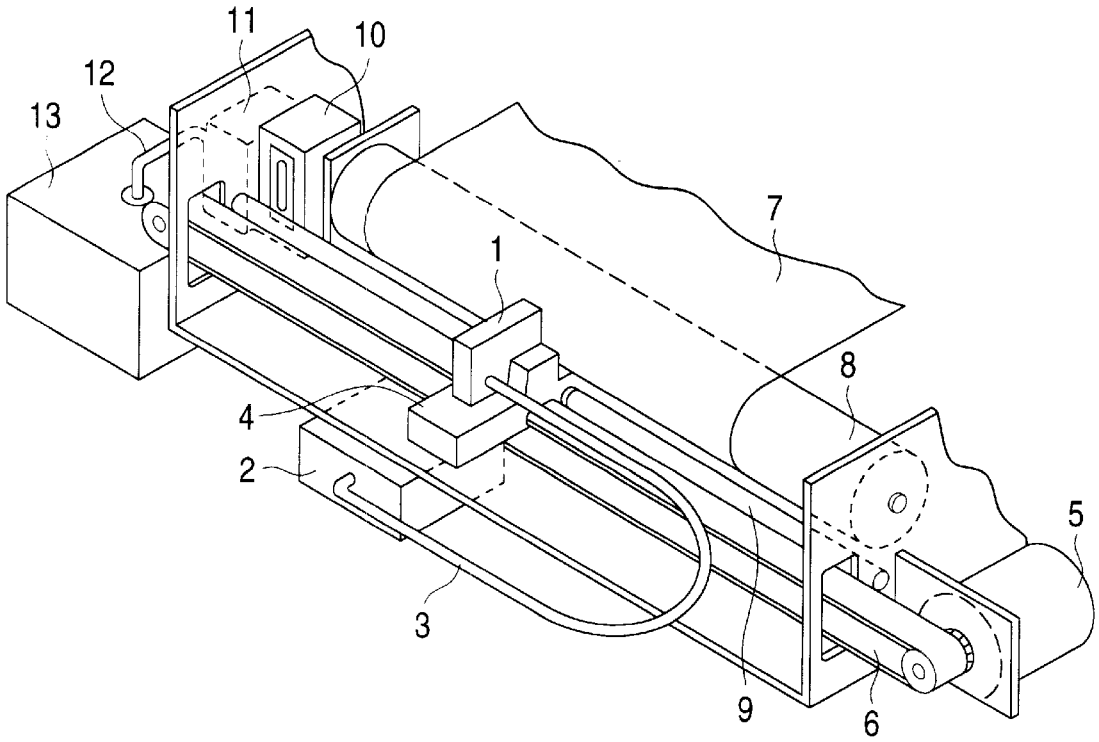
FIG. 42 shows a perspective view of an ink-jet recording apparatus.

First, an ink-jet recording apparatus on which an ink-jet recording head of the invention is mounted is described, referring to FIG. 42.

In FIG. 42, an ink-jet recording head 1 of the invention (described later) is mounted on a carriage 4 fixed to a timing belt 6 driven by a motor 5. The ink-jet recording head 1 reciprocates while guiding by a guide 9 in the width direction of a sheet 7 fed by a platen 8. An ink used for ejection is supplied from an ink cartridge 2 containing an ink composition to the ink-jet recording head 1 via an ink supplying tube 3.

A capping device 10 seals nozzle openings of the ink-jet recording head 1 in order to avoid clogging the nozzle openings. The capping device 10 connecting with an absorbing pump 11 can compulsory discharge the ink form the ink-jet recording head for recovering the clog of the nozzle openings. The absorbing pump 11 connects with a waste ink tank via a tube 12.

The invention may be applicable to an ink-jet recording apparatus in which an ink cartridge is mounted on a carriage, or an ink-jet recording apparatus in which the recording head and ink cartridge are formed as one unit.

Figure 1:
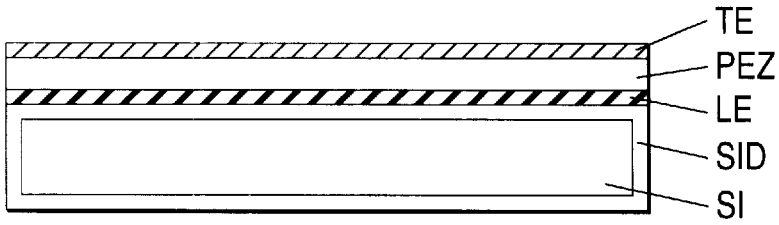
FIG. 1 is a cross sectional view showing a first step of a manufacturing process of an ink-jet recording head according to a first embodiment of the present invention.

A first embodiment of the present invention is described, FIG. 1 is a cross sectional view showing a first step of a manufacturing process of an ink-jet recording head according to the present invention. Hereafter, the structure of the ink-jet recording head to be produced will be illustrated with the progress of this manufacturing process.

First, as shown in FIG. 1, a silicon substrate SI is oxidized in a gas containing oxygen at 1100° C. to form a silicon oxide thin film having a film thickness of 1 $\mu$m.

Next, a first metal thin film LE is deposited onto a first main surface of the silicon substrate by the sputtering method, the vapor deposition method or the MO-CVD method. The material of this metal thin film is preferably a metal low in reactivity with a lead zirconate titanate thin film PEZ, such as platinum, iridium or an alloy thereof.

For example, a platinum film having a thickness of 700 nm is deposited as the first metal thin film on to the substrate by the sputtering method in which the substrate is heated at a temperature of 200° C. Then, lead zirconate titanate PEZ having a thickness of 0.5 to 5 $\mu$m is deposited onto the above-mentioned first metal thin film by any of the sputtering method, the sol-gel method and vapor deposition method.

The silicon substrate on which lead zirconate titanate PEZ has been formed is polycrystallized by the RTA (rapid thermal annealing) method at 900° C. or annealing treatment in a diffusion furnace at 700° C.

A second metal thin film TE is further deposited onto the above-mentioned annealed lead zirconate titanate PEZ. In order to prevent electrolytic corrosion in a photolithography step, it is desirable that this metal thin film TE is formed of a material identical to that of the first metal thin film in electrochemical potential. For example, the first and second metal thin films are preferably formed of the same platinum material. A cross sectional view of the substrate which has accomplished a series of steps described above is shown in FIG. 1.

Figure 2:
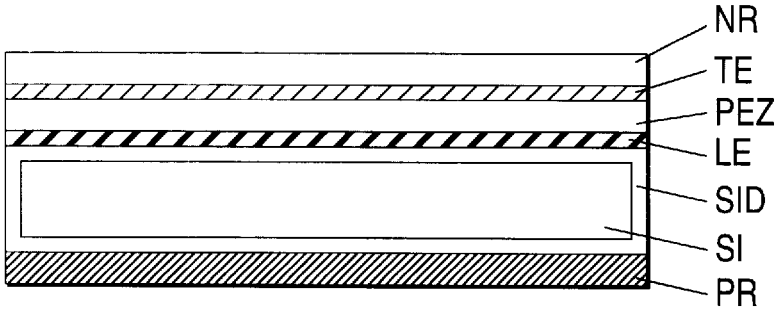
FIG. 2 is a cross sectional view showing a subsequent step.

Then, as shown in FIG. 2, a negative photoresist NR is applied by the spin coating method to the first main surface of the above-mentioned silicon substrate which has accomplished a series of steps shown in FIG. 1 to form a film having a thickness of 2 $\mu$m. Subsequently, a positive photoresist PR is applied by the spin coating method to a second main surface of the silicon substrate to form a film having a thickness of 1 $\mu$m. After film formation of the respective photoresists, annealing treatment is conducted at 140° C. for 30 minutes.

Figure 3:
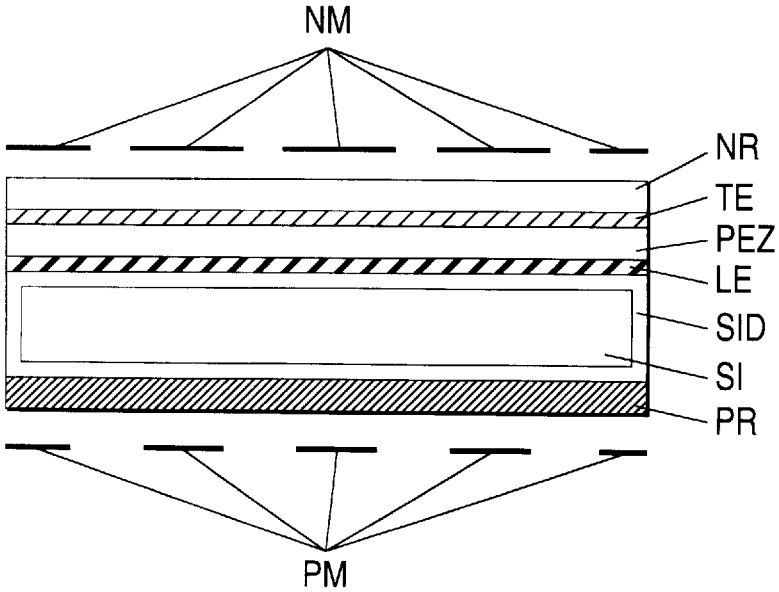
FIG. 3 is a cross sectional view showing a subsequent step.

Next, alignment is performed between a negative mask NM for exposing the negative photoresist NR to light and a positive mask PM for exposing the positive photoresist PR to light, and the silicon substrate SI shown in FIG. 2 is inserted between the negative mask NM and the positive mask PM as shown in FIG. 3.

The silicon substrate SI also has alignment marks for alignment, so that exact alignment is possible between the negative mask NM or the positive mask PM and the silicon substrate SI.

Figure 4:
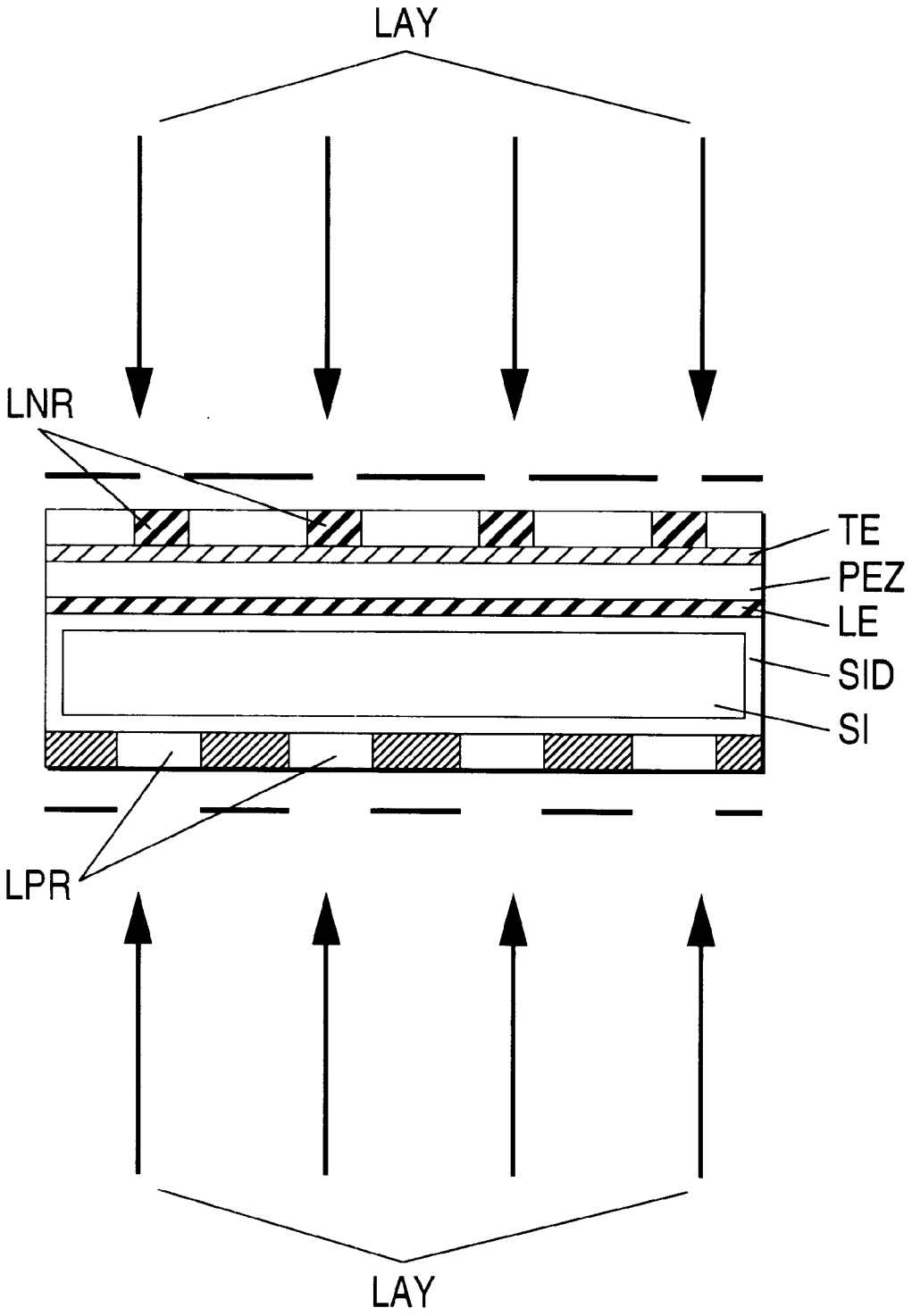
FIG. 4 is a cross sectional view showing a subsequent step.

Then, as shown in FIG. 4, both surfaces of the silicon substrate SI are irradiated with ultraviolet light rays LAY to expose the positive resist PR and the negative resist NR formed on the silicon substrate to light. In FIG. 4, a light-exposed area of the negative resist is indicated by LNR, and a light-exposed area of the positive resist by LPR.

Figure 5:
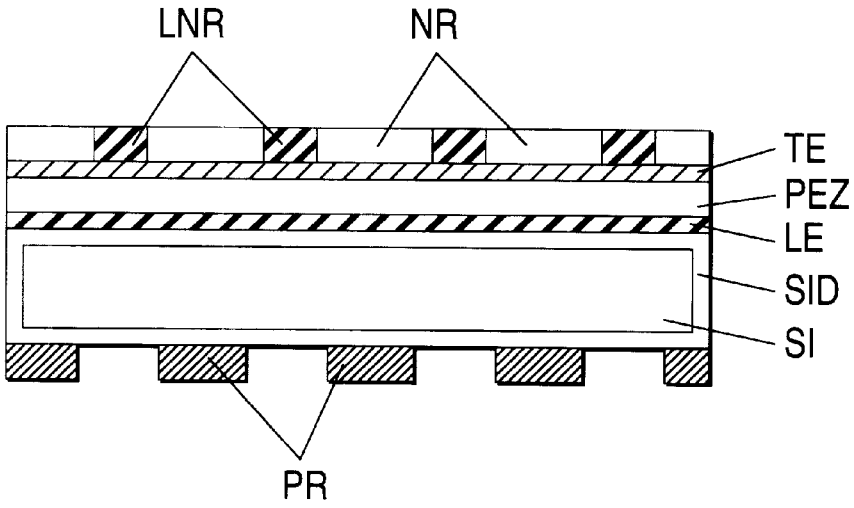
FIG. 5 is a cross sectional view showing a subsequent step.
Figure 6:
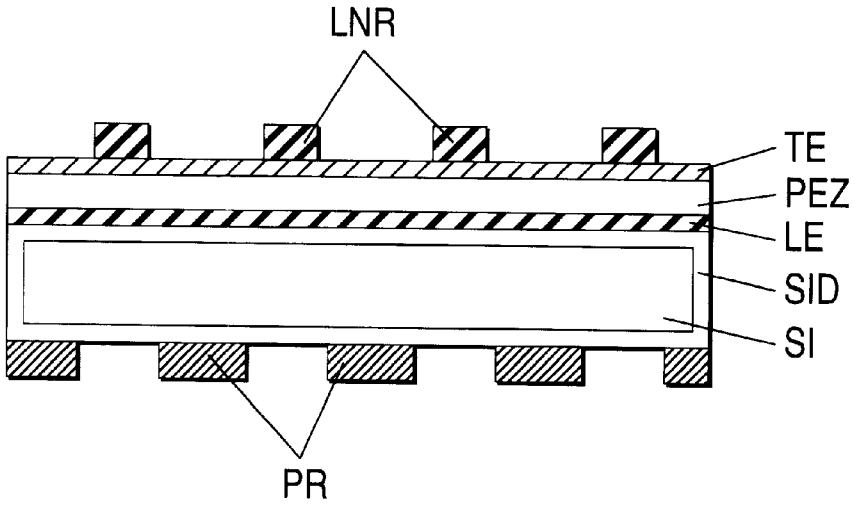
FIG. 6 is a cross sectional view showing a subsequent step.

Then, as shown in FIG. 5, the light-exposed area LPR of the positive resist is dissolved with a developing solution which is an alkaline aqueous solution to remove it. Thereafter, as shown in FIG. 6, the negative resist is dissolved with a developing solution which is an organic solvent to remove it so as to leave the light-exposed area LNR thereof.

Figure 7:
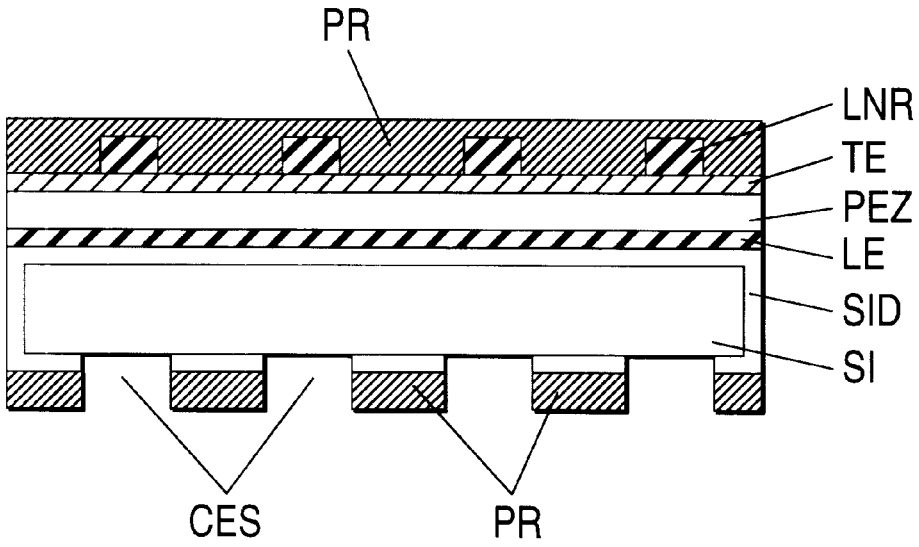
FIG. 7 is a cross sectional view showing a subsequent step.

Subsequently, as shown in FIG. 7, a positive resist PR having a thickness of 1 $\mu$m is deposited onto the first main surface of the silicon substrate SI so as to cover the negative resist area LNR irradiated with light. Further, a silicon oxide film SID exposed on the second main surface of the above-mentioned silicon substrate SI is etched with an aqueous solution containing hydrofluoric acid as a main component to remove it, thereby exposing a silicon surface CES of the second main surface of the silicon substrate.

Then, both surfaces of the first and second main surfaces of the silicon substrate are irradiated with light to expose the positive resist PR to light, and the resist is dissolved with a developing solution which is an alkaline aqueous solution to remove it. In the case of the positive resist, it is easily dissolved and removed with the developing solution by irradiation of ultraviolet light.

Figure 8:
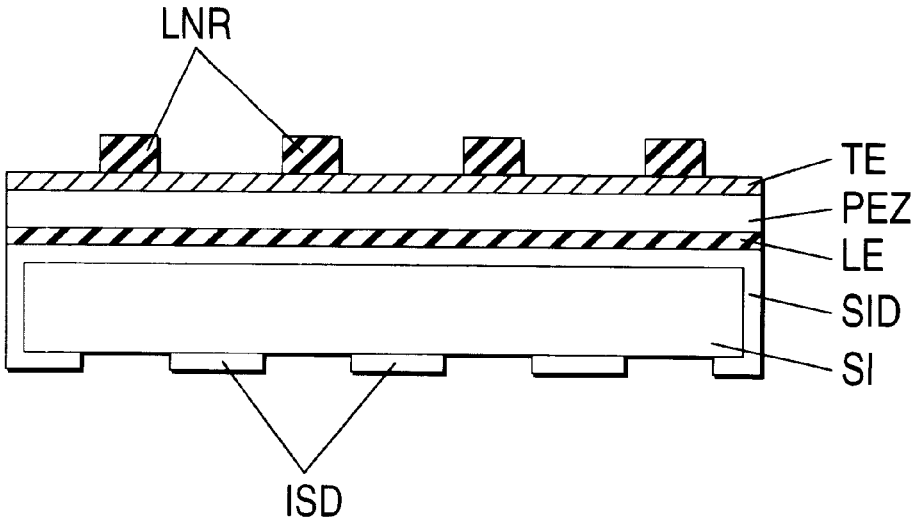
FIG. 8 is a cross sectional view showing a subsequent step.

When the first metal thin film is the same as the second metal thin film in the material or electrochemical potential, separation of the positive resist with the developing solution which is the alkaline aqueous solution does not introduce the problem of electrolytic corrosion. As shown in FIG. 8, the negative resist area LNR exposed to light is exposed on the first main surface of the silicon substrate SI, and the patterned silicon oxide film ISD is exposed on the second main surface of the silicon substrate SI.

Figure 9:
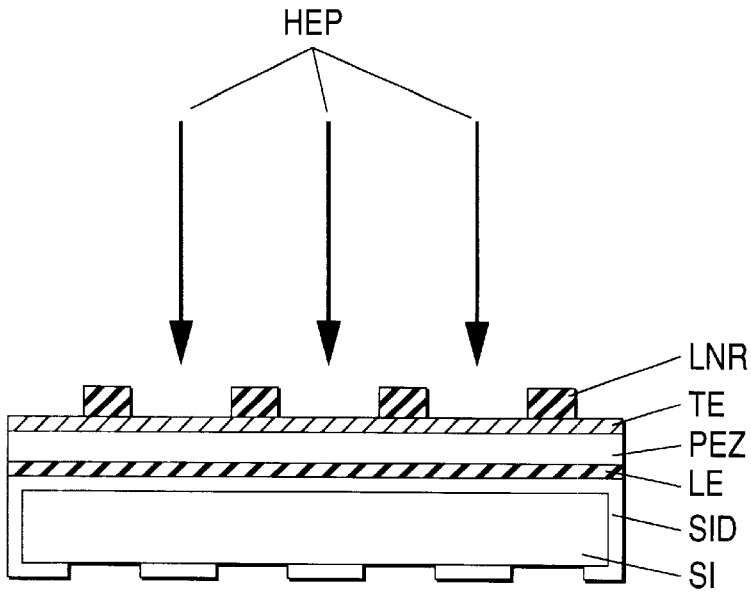
FIG. 9 is a cross sectional view showing a subsequent step.

Then, as shown in FIG. 9, the first main surface of the silicon substrate is irradiated with high energy particles HEP, and the second metal thin film is etched using the negative resist area LNR as a mask to remove it. Further, etching by continuous irradiation of the high energy particles forms a patterned piezoelectric thin film EPZ. For example, the high energy particles HEP are argon ions or atoms accelerated at a voltage of 400 V.

Figure 10:
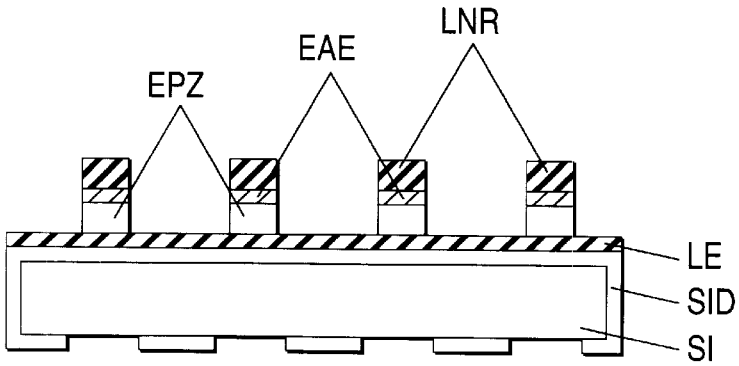
FIG. 10 is a cross sectional view showing a subsequent step.

By this step, as shown in FIG. 10, the patterned piezoelectric thin film EPZ and a patterned second metal thin film EAE are formed.

Figure 11:
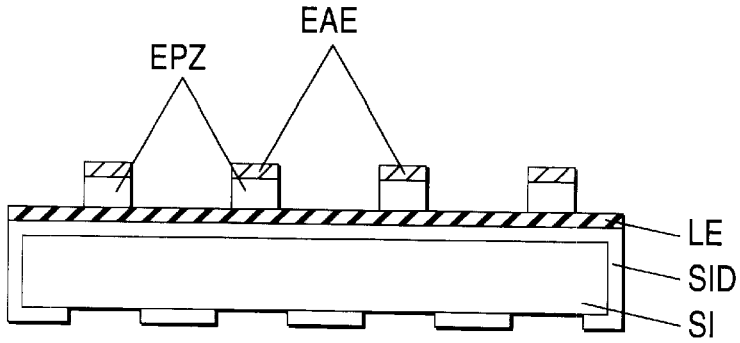
FIG. 11 is a cross sectional view showing a subsequent step.

Next, as shown in FIG. 11, the negative resist area LNR irradiated with ultraviolet light is removed by ashing in oxygen plasma generated by microwaves, for example, at an output of 250 W at a flow rate of oxygen of 100 sccm for 10 minutes, thereby exposing a surface of the second metal thin film EAE.

Figure 12:
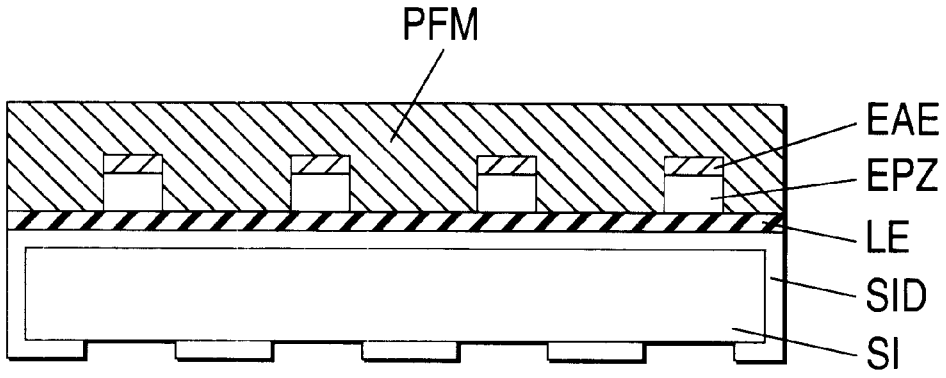
FIG. 12 is a cross sectional view showing a subsequent step.

Subsequently, as shown in FIG. 12, a protective film PFM not corrosible with an alkaline solution is deposited onto the whole surface of the first main surface of the silicon substrate so as to cover the patterned piezoelectric thin film EPZ and the patterned second metal thin film EAE. This protective film is a fluorine-containing organic film having a thickness of 5 μm.

Figure 13:
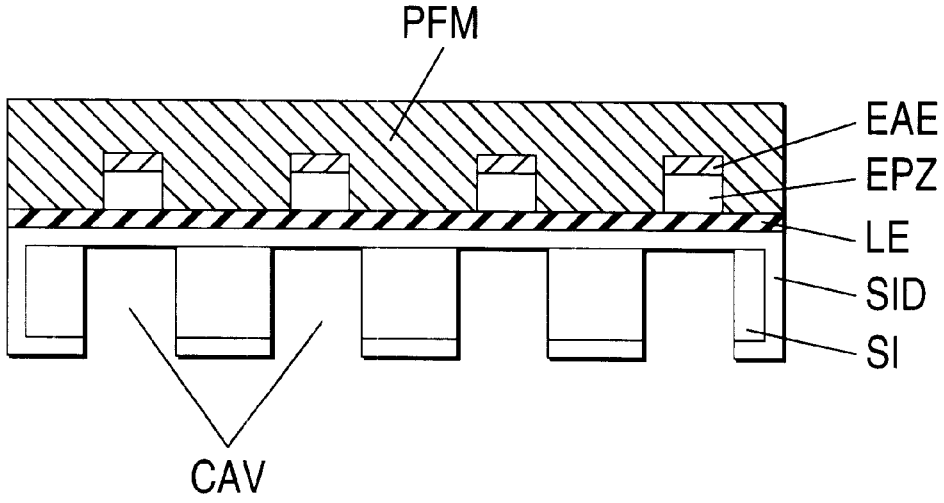
FIG. 13 is a cross sectional view showing a subsequent step.

Then, as shown in FIG. 13, the silicon substrate with the protective film PFM deposited onto it is immersed in an alkaline aqueous solution which can etch silicon selectively with respect to the orientation of the silicon crystal to etch silicon exposed on the second main surface until the silicon oxide film SID on the side of the first main surface of the silicon substrate SI is exposed, thereby forming ink cavity chambers CAV. This alkaline aqueous solution is, for example, a 10% aqueous solution of potassium hydroxide having a temperature of 80° C.

Figure 14:
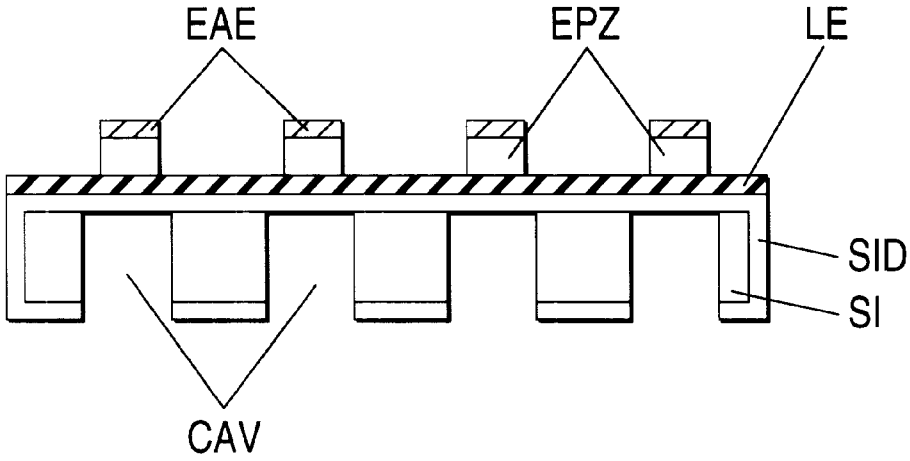
FIG. 14 is a cross sectional view showing a subsequent step.

Subsequently, as shown in FIG. 14, the protective film PFM is separated in oxygen plasma to remove it, thereby forming a substrate for an ink-jet recording head utilizing the patterned piezoelectric thin film EPZ.

Figure 15:
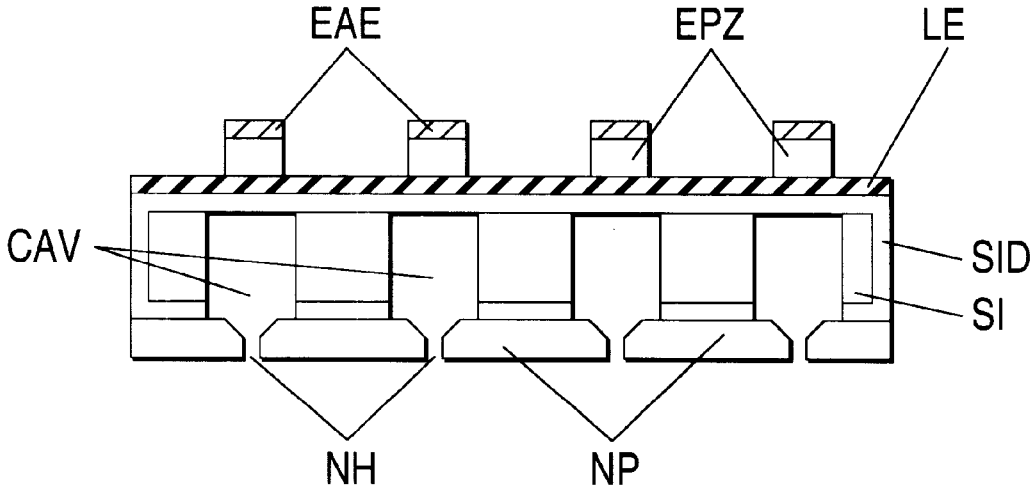
FIG. 15 is a cross sectional view showing a subsequent step.

Further, as shown in FIG. 15, a nozzle plate NP having ink discharge nozzles NH is adhered thereto so as to cover the ink cavity chambers, thereby forming the ink-jet recording head. The ink-jet recording head thus constructed is mounted on an ink-jet recording apparatus.

Figure 16:
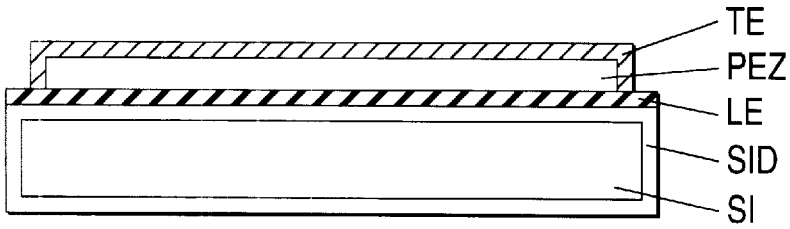
FIG. 16 is a cross sectional view showing a first step of a manufacturing process of an ink-jet recording head according to a second embodiment of the present invention.

Next, a second embodiment of the present invention is described. As shown in FIG. 16, a silicon oxide film SID is formed on a silicon substrate SI in the same manner as with FIG. 1. A first metal thin film LE is further deposited onto a first main surface of the silicon substrate. Then, lead zirconate titanate PEZ is deposited onto the above-mentioned first metal thin film LE. A second metal thin film TE is further deposited on the lead zirconate titanate PEZ. As this second metal thin film, for example, an aluminum thin film having a thickness of 100 nm to 500 nm is formed by the sputtering method at a heating temperature of 150° C.

To be exact, as shown in FIG. 16, the second metal thin film TE is in contact with the first metal thin film at its peripheral portion, and both are in the conductive state. Although this is also the same for FIG. 1, this is omitted in FIG. 1. As described above, for one described in FIG. 1, immersion of the ink-jet recording head in the alkaline aqueous solution which is the developing solution for the positive resist does not introduce the problem of electrolytic corrosion, even if the first and second metal thin films are in the conductive state, because both are formed of the same platinum material.

Figure 17:
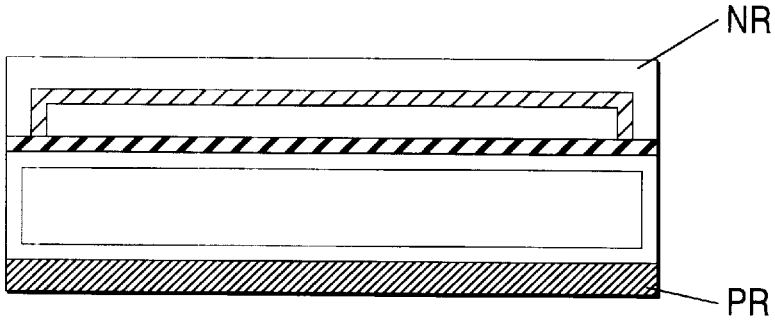
FIG. 17 is a cross sectional view showing a subsequent step.

Then, as shown in FIG. 17, a negative photoresist NR having a thickness of 2 μm is deposited onto the aluminum thin film TE which is the second metal thin film so as to cover it from above. A positive photoresist PR having a thickness of 1 μm is further similarly deposited onto the silicon oxide film SID on a second main surface of the silicon substrate. The respective photoresists are formed into films, followed by annealing treatment.

Figure 18:
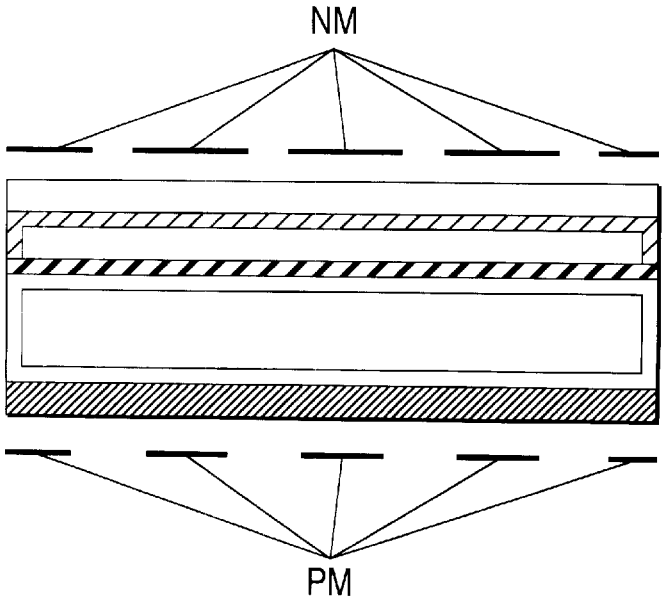
FIG. 18 is a cross sectional view showing a subsequent step.

Thereafter, as shown in FIG. 18, alignment is performed between a negative mask NM for exposing the negative photoresist NR to light and a positive mask PM for exposing the positive photoresist PR to light, and the silicon substrate SI on which the films have been formed is inserted between the negative mask NM and the positive mask PM.

Figure 19:
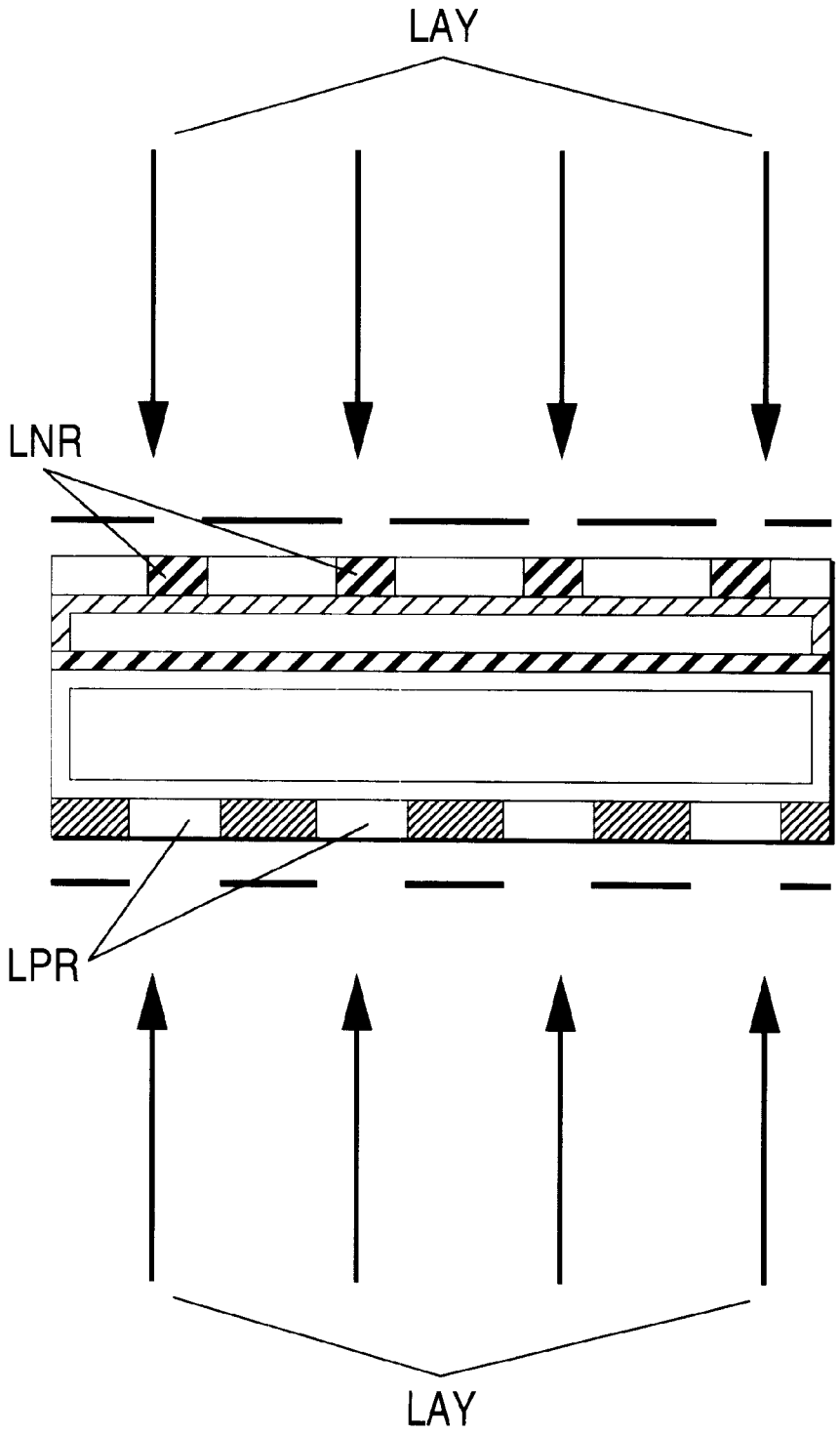
FIG. 19 is a cross sectional view showing a subsequent step.

Subsequently, as shown in FIG. 19, both surfaces of the silicon substrate SI are irradiated with ultraviolet light rays LAY to expose the positive resist PR and the negative resist NR formed on the silicon substrate to light. In FIG. 19, a light-exposed area of the negative resist is indicated by LNR, and a light-exposed area of the positive resist by LPR.

Figure 20:
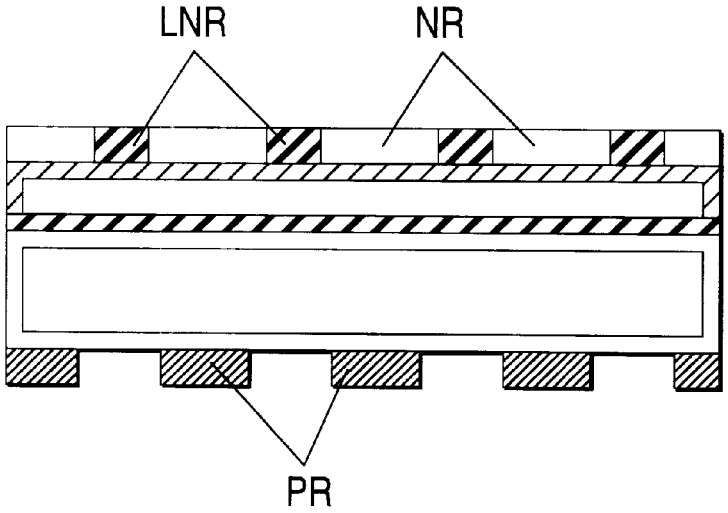
FIG. 20 is a cross sectional view showing a subsequent step.

Then, as shown in FIG. 20, the light-exposed area LPR of the positive resist is dissolved with a developing solution which is an alkaline aqueous solution to remove it. The parts of the positive resist PR not removed may collectively be referred to as a plurality of positive resist patterns.

Figure 21:
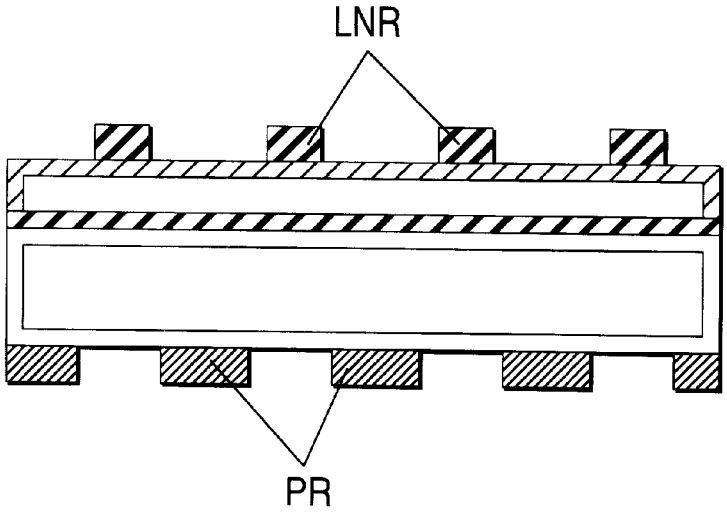
FIG. 21 is a cross sectional view showing a subsequent step.

Thereafter, as shown in FIG. 21, the negative photoresist is dissolved with a developing solution which is an organic solvent to remove it so as to leave the light-exposed area LNR thereof. The light exposed areas LNR may be collectively referred to as a plurality of negative resist patterns.

As shown in this embodiment, the organic solvent is used for development of the photoresist on the aluminum thin film, the second metal thin film, which is base in electrochemical properties to platinum, the first metal thin film. Accordingly, even if the first and second metal thin films are in the conductive state, the second metal thin film can be formed without generation of electrolytic corrosion.

Figure 22:
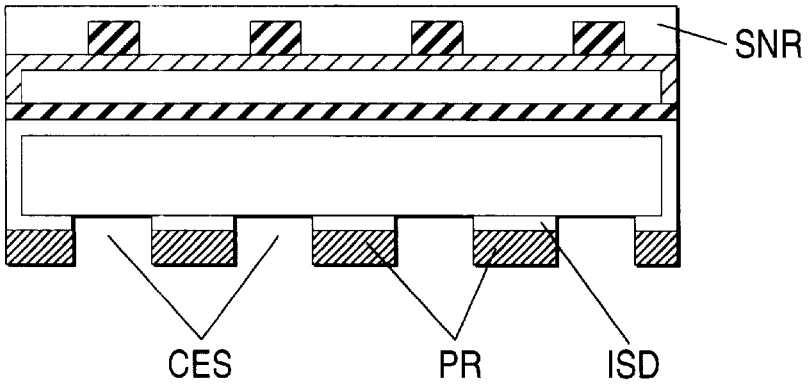
FIG. 22 is a cross sectional view showing a subsequent step.

Subsequently, as shown in FIG. 22, a second negative photoresist SNR having a thickness of 1 μm is deposited onto the first main surface of the silicon substrate SI without irradiation of ultraviolet light so as to cover the negative photoresist area LNR irradiated with light. Further, a silicon oxide film SID exposed on the second main surface of the above-mentioned silicon substrate SI is etched with an aqueous solution containing hydrofluoric acid as a main component to remote it, thereby exposing a silicon surface CES of the second main surface of the silicon substrate. The parts ISD of the silicon oxide film not etched away may be referred to as a plurality of lower silicon oxide film patterns. Like this, the negative photoresist is deposited onto the whole surface of the first main surface. Accordingly, damage such as separation does not occur to the thin film on the first main surfaces, even if the silicon oxide film on the second main surface is etched with hydrofluoric acid, a strong acid.

Figure 23:
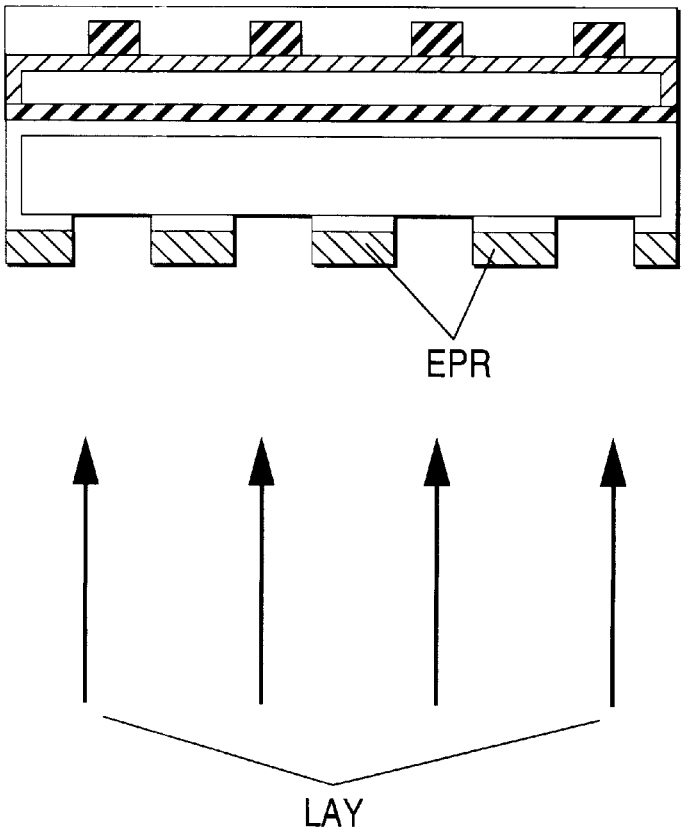
FIG. 23 is a cross sectional view showing a subsequent step.
Figure 24:
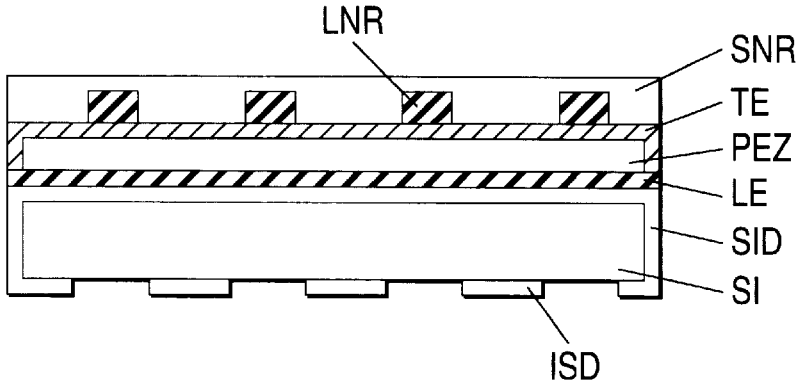
FIG. 24 is a cross sectional view showing a subsequent step.

Then, as shown in FIG. 23, the second main surface is irradiated with ultraviolet light to expose the positive photoresist PR to light, and as shown in FIG. 24, the positive photoresist is dissolved with a developing solution which is an alkaline aqueous solution to remove it. In the case of the positive photoresist, it is easily dissolved and removed with the developing solution by irradiation of ultraviolet light. This developing solution is an inorganic alkaline solution or an organic alkaline solution. However, the thin film on the first main surface does not change, because the negative photoresist is deposited as the protective film SNR onto the first main surface so as to also cover the periphery of the second electrode thin film TE.

Figure 25:
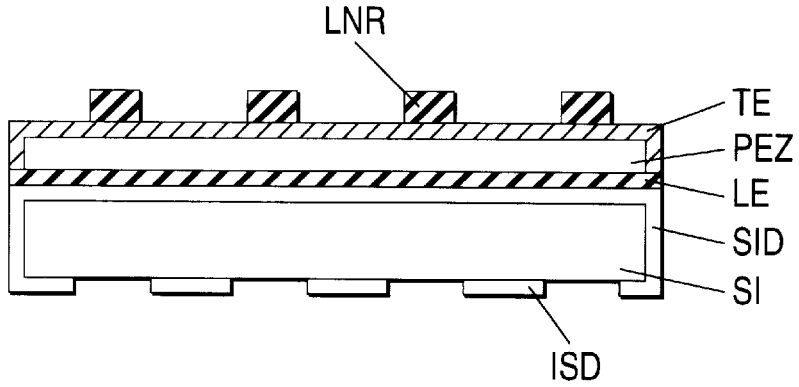
FIG. 25 is a cross sectional view showing a subsequent step.

Next, as shown in FIG. 25, the second negative photoresist SNR formed on the first main surface of the silicon substrate is separated with a developing solution which is an organic solution.

When a piezoelectric thin film is formed on the first metal thin film by the sol-gel method or the sputtering method, and a second metal thin film containing at least one kind of metal lower in standard oxidation reduction potential than the first metal thin film is further formed on the piezoelectric thin film, the covering of the piezoelectric thin film at edge portions of the substrate is generally incomplete. Accordingly, the first metal thin film comes into contact with the second metal thin film at the edge portions of the substrate as described above referring to FIG. 16.

Supposing that the protective film for the piezoelectric element against hydrofluoric acid is a positive photoresist in case that the first metal thin film and the second metal thin film containing at least one kind of metal lower in standard oxidation reduction potential than the first metal thin film are formed, and the silicon oxide film on the second main surface is patterned with hydrofluoric acid, the developing solution used in separating this positive photoresist is an inorganic electrolytic solution containing 4% sodium hydrogenphosphate and 7% sodium silicate. When the first and second electrodes are in the conductive state, therefore, a battery is formed by this electrolytic solution. Accordingly, the difference in electrochemical potential or oxidation reduction potential results in the electrolytic corrosion phenomenon that either of the first and second metal thin films is separated from the substrate or dissolved in the electrolytic solution.

Further, even when separation is intended to be performed with oxygen plasma without use of the developing solution which is the electrolytic solution, the negative photoresist for the second electrode pattern is almost similar to the positive photoresist acting as the protective film in rate of reaction with the oxygen plasma. It is therefore very difficult to selectively separate the positive photoresist acting as the protective film. On the other hand, the separating solution for the negative photoresist is the organic solvent, and therefore has no danger of electrolytic corrosion.

For this reason, when the silicon oxide film on the second main surface is etched with hydrofluoric acid, the negative photoresist is suitable as the protective film SNR to the piezoelectric element, thereby generating no electrolytic corrosion in the metal thin films between which the piezoelectric thin film is put.

Figure 26:
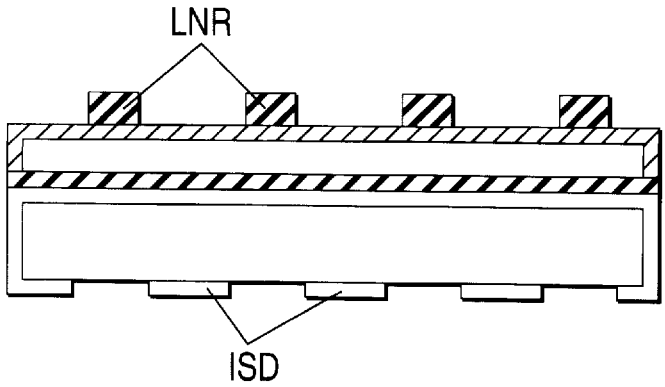
FIG. 26 is a cross sectional view showing a subsequent step.

As shown in FIG. 26, the light-exposed negative photoresist area LNR is exposed on the first main surface of the silicon substrate SI, and the patterned silicon oxide film ISD is exposed on the second main surface of the silicon substrate SI.

Figure 27:
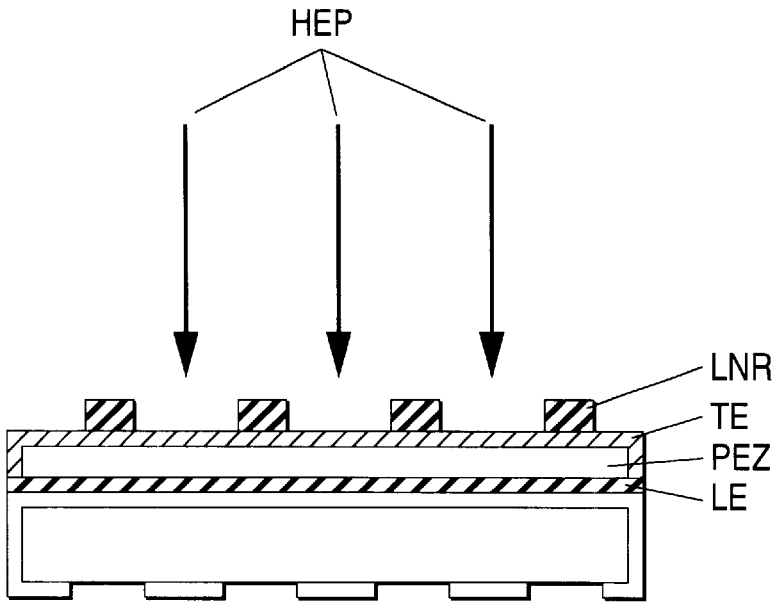
FIG. 27 is a cross sectional view showing a subsequent step.

Then, as shown in FIG. 27, the first main surface of the silicon substrate is irradiated with high energy particles HEP, and the second metal thin film is etched using the negative resist area LNR as a mask to remote it. Further, etching by continuous irradiation of the high energy particles forms a patterned piezoelectric thin film EPZ.

Figure 28:
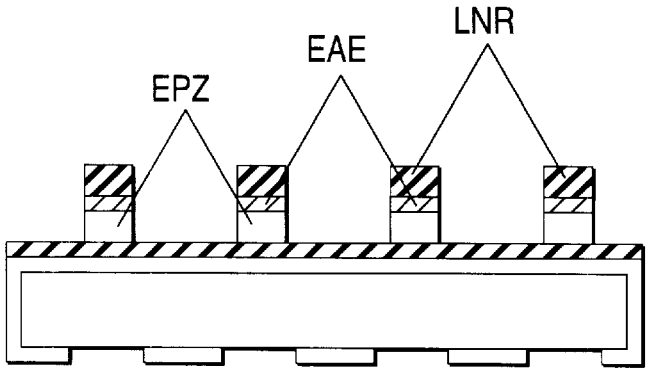
FIG. 28 is a cross sectional view showing a subsequent step.

By this step, as shown in FIG. 28, the patterned piezoelectric thin film EPZ and a patterned second metal thin film EAE are formed.

Figure 29:
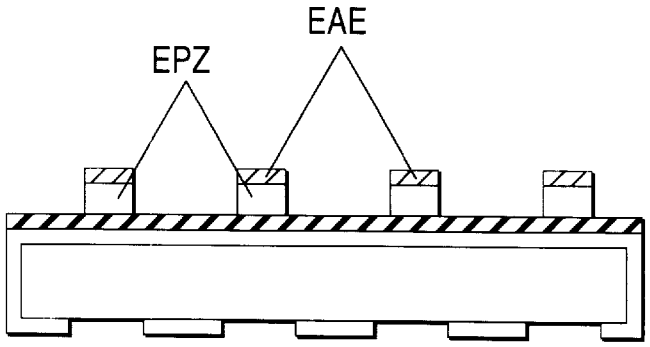
FIG. 29 is a cross sectional view showing a subsequent step.

Next, as shown in FIG. 29, the negative resist area LNR irradiated with ultraviolet light is removed by ashing in oxygen plasma generated by microwaves, for example, at an output of 250 W at a flow rate of oxygen of 250 sccm for 15 minutes, thereby exposing a surface of the second metal thin film EAE.

Figure 30:
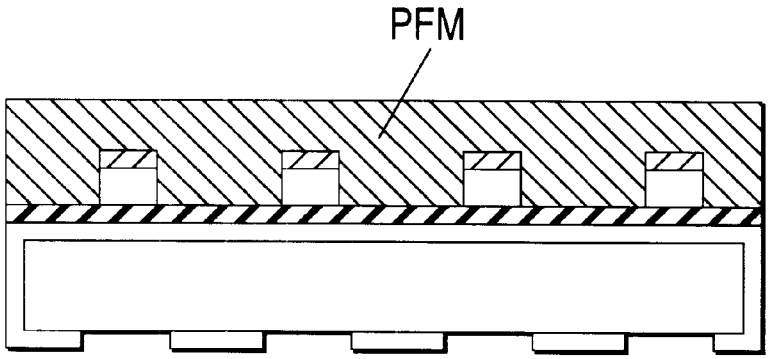
FIG. 30 is a cross sectional view showing a subsequent step.

Subsequently, as shown in FIG. 30, a protective film PFM not corrosible with an alkaline solution is deposited onto the whole surface of the first main surface of the silicon substrate so as to cover the patterned piezoelectric thin film EPZ and the patterned second metal thin film EAE. This protective film is a fluorine resin having a thickness of 5 $\mu$m.

Figure 31:
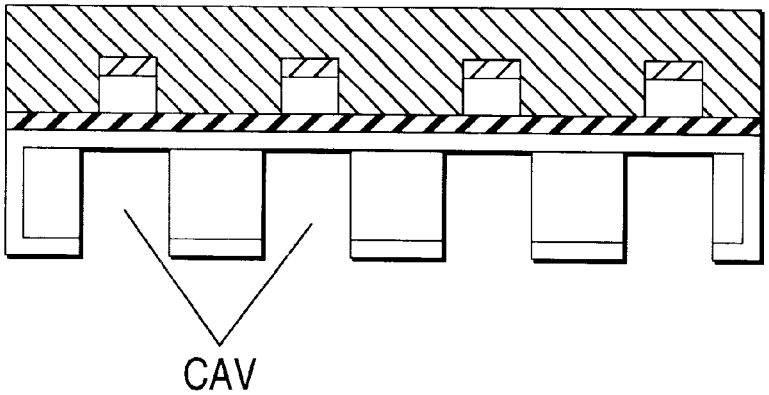
FIG. 31 is a cross sectional view showing a subsequent step.

Then, as shown in FIG. 31, the silicon substrate with the protective film PFM deposited onto it is immersed in an alkaline aqueous solution which can anisotropically etch silicon to etch silicon exposed on the second main surface until the silicon oxide film SID on the side of the first main surface of the silicon substrate SI is exposed, thereby forming ink cavity chambers CAV.

Figure 32:
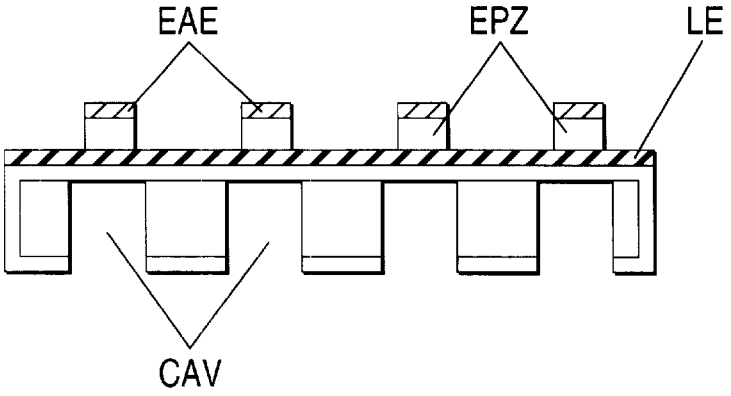
FIG. 32 is a cross sectional view showing a subsequent step.

Subsequently, as shown in FIG. 32, the protective film PFM is separated in oxygen plasma to remote it, thereby forming a substrate for an ink-jet recording head utilizing the patterned piezoelectric thin film EPZ.

Figure 33:
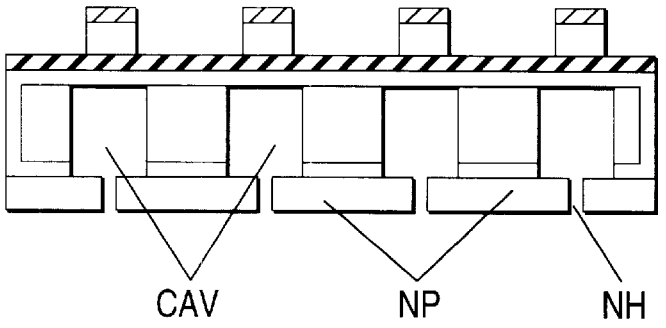
FIG. 33 is a cross sectional view showing a subsequent step.

Further, as shown in FIG. 33, a nozzle plate NP having ink discharge nozzles NH is adhered thereto so as to cover the ink cavity chambers, thereby forming the ink-jet recording head. The ink-jet recording head thus constructed is mounted on an ink-jet recording apparatus.

In the above-mentioned embodiment, the case in which the second metal thin film is the aluminum thin film is illustrated. However, the second metal thin film is not limited to aluminum. For example, also when the metal thin film in contact with lead zirconate titanate is a two-layer thin film consisting of a titanium film having a thickness of 50 nm and a gold thin film having a thickness of 200 nm formed continuously to this titanium film, the present invention can also be applied. The gold thin film is very low in Young's modulus and flexible, so that it can sufficiently displace an actuator. Further, the gold thin film is low in specific resistance. It is therefore possible to transmit a signal from a driver circuit with little generation of strain. Furthermore, the gold thin film is not oxidized in the atmosphere, different from aluminum. Accordingly, no contact resistance is generated in connection such as soldering of driver ICs, so that the strain of the driver signal is not generated.

Figure 34:
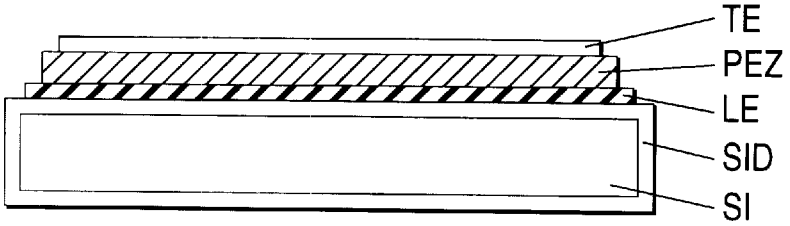
FIG. 34 is a cross sectional view showing a first step of a manufacturing process of an ink-jet recording head according to a third embodiment of the present invention
Figure 35:
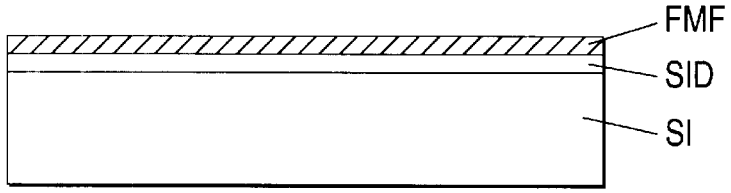
FIG. 35 is a cross sectional view showing a first step of a manufacturing process of a conventional ink-jet recording head.
Figure 36:
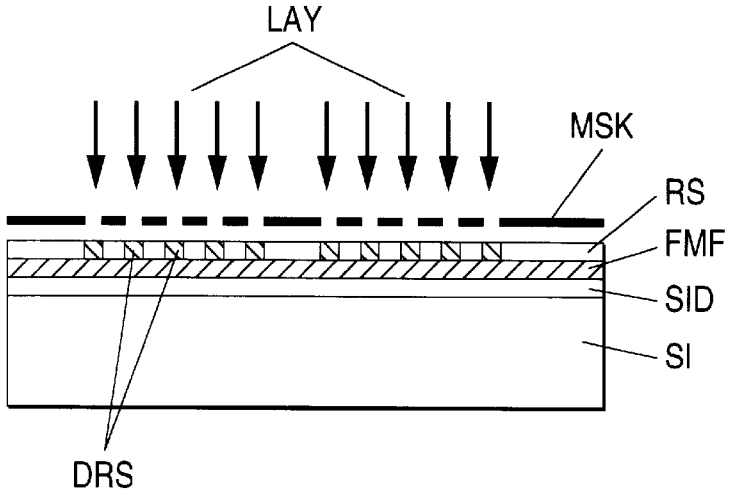
FIG. 36 is a cross sectional view showing a subsequent step.
Figure 37:
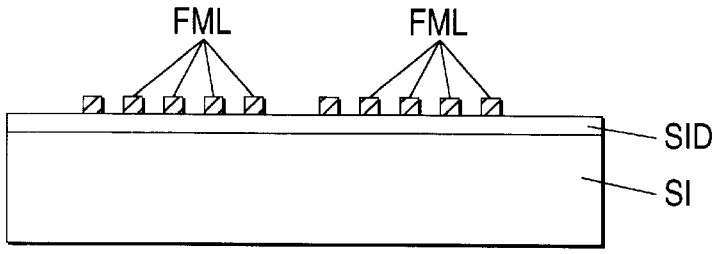
FIG. 37 is a cross sectional view showing a subsequent step.
Figure 38:
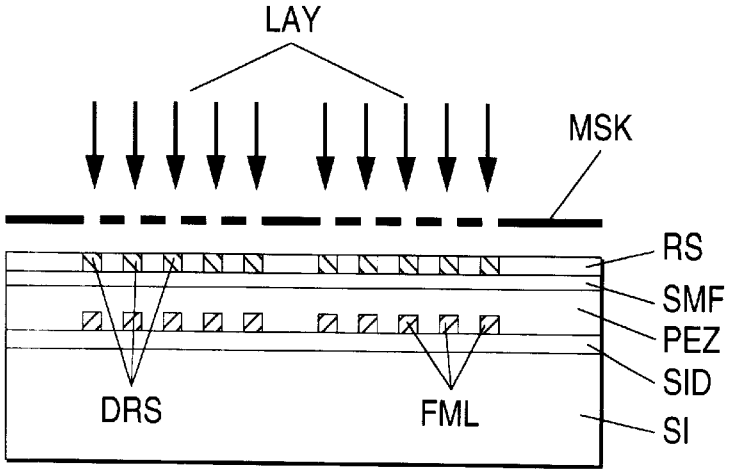
FIG. 38 is a cross sectional view showing a subsequent step.
Figure 39:
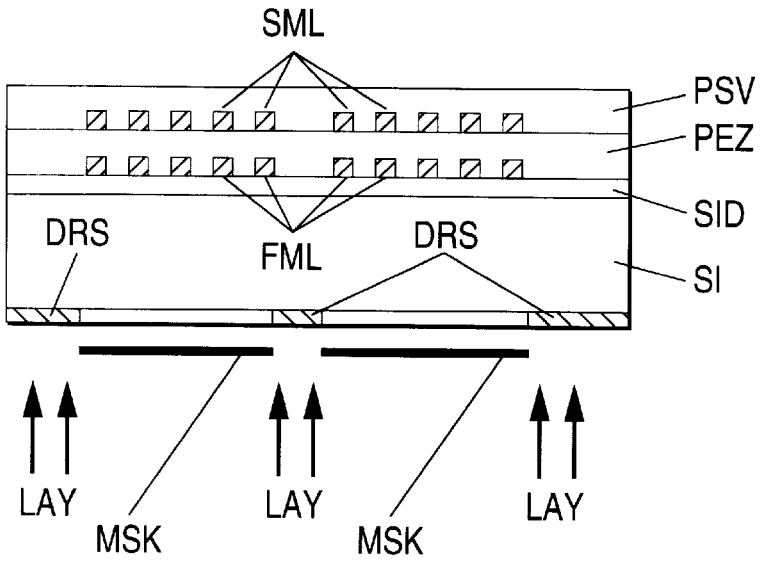
FIG. 39 is a cross sectional view showing a subsequent step.
Figure 40:
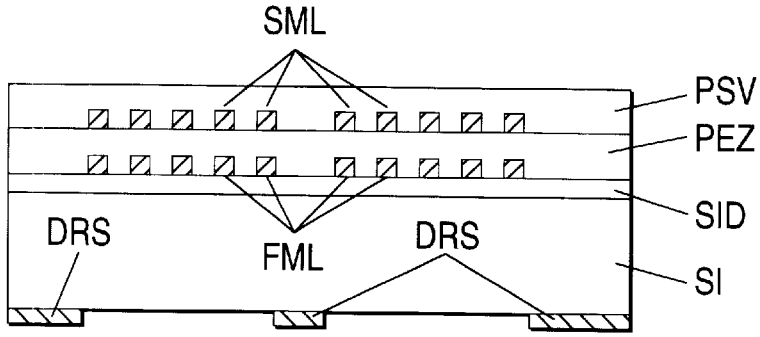
FIG. 40 is a cross sectional view showing a subsequent step.
Figure 41:
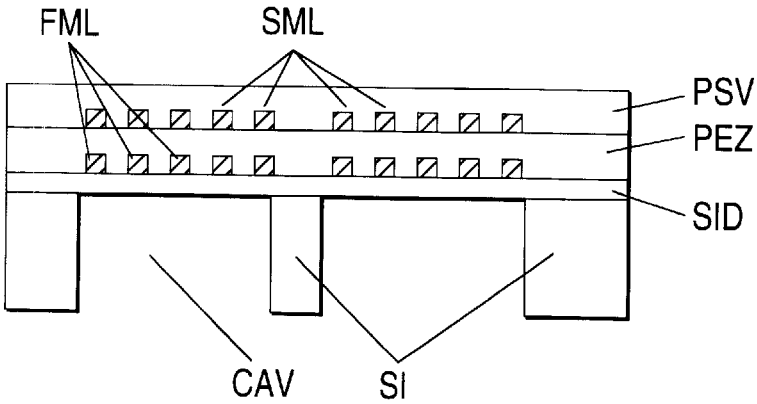
FIG. 41 is a cross sectional view showing a subsequent step.

Then, a third embodiment of the present invention is illustrated. In this embodiment, in order to prevent conduction of a first electrode to a second electrode in a manufacturing process of an ink-jet recording head, the second electrode TE is formed smaller than a piezoelectric body so as to be positioned inside a peripheral portion of lead zirconate titanate PEZ formed on the first electrode, as shown in FIG. 34. Referring to FIG. 34 and later, the ink-jet recording head is produced based on the above-mentioned first embodiment. In this embodiment, in the manufacturing course of the ink-jet recording head, the first electrode is not rendered conductive to the second electrode. Accordingly, generation of electrolytic corrosion in the electrodes can be avoided, even if the first and second electrodes are exposed to a developing solution for a positive resist in patterning the ink-jet recording head.

The above-mentioned description has stated that the problem of electrolytic corrosion between the electrodes occurs when the first and second electrodes are exposed to the electrolytic solution which is the developing solution for the positive resist. However, this problem of electrolytic corrosion also occurs when a developing solution for a negative resist is an electrolytic solution. Accordingly, the problem of electrolytic corrosion in the present invention will occur when a resist is developed with an electrolytic solution, whether the resist is positive or negative. The present developing solution for the resist is an electrolytic solution, a solution of a mixture of sodium silicate and sodium hydrogenphosphate, for the positive resist, and an organic solvent, not an electrolytic solution, such as a mixed solution of xylene and benzene, for the negative resist. The present invention is therefore understood that exposure of the electrode to the resist developing solution which is the electrolytic solution is avoided.

According to the ink-jet recording head of the present invention, damage such as separation or dissolution of the metal thin films caused by electrolytic corrosion does not occur in the manufacturing course of the ink-jet recording head, because the first ant second metal thin films are the same.

That is, if the material of the first metal thin film of a piezoelectric element device is the same as that of the second metal thin film in electrochemical potential on both-surface simultaneous exposure, a substrate for the ink-jet recording head can be formed without occurrence of damage such as separation or dissolution of the metal thin films in the piezoelectric element device.

Further, no positive resist is used in the photolithography process of the first main surface of the substrate, so that damage such as separation or dissolution of the metal thin films caused by electrolytic corrosion does not occur in the manufacturing course of the ink-jet recording head.

Accordingly, even if the first metal thin film on the piezoelectric element device is different from the second metal thin film in material on both-surface simultaneous exposure, the substrate for the ink-jet recording head can be formed without occurrence of damage in the piezoelectric element device.

Furthermore, even if the material of the first metal thin film of the piezoelectric element device is different from that of the second metal thin film in electrochemical potential on both-surface simultaneous exposure, the substrate for the ink-jet recording head can be formed without occurrence of damage such as separation or dissolution of the metal thin films in the piezoelectric element device.

In addition, the use of a platinum thin plate having a higher Young's modulus as the first metal thin film, and an aluminum thin film having a lower Young's modulus as the second metal thin film results in occurrence of the displacement of the diaphragm twice or more that of the prior art, which makes it possible to discharge ink droplets twice or more those of the prior art. Accordingly, the recording apparatus using the ink-jet recording head of the present invention can realize very clear printing quality.

What is claimed is:

1. An intermediate product for use in the production of an ink jet recording head, comprising:

a substrate member comprising a silicon substrate, an upper silicon oxide film, and a plurality of lower silicon oxide film patterns, said upper silicon oxide film being on an upper surface of said silicon substrate, and said plurality of lower silicon oxide film patterns being on said lower surface of said silicon substrate;

a first electrode layer on said upper silicon oxide film;

a piezoelectric film on said first electrode layer;

a second electrode layer on said piezoelectric film, and in contact with said first electrode layer;

a plurality of negative resist patterns, on said second electrode layer, formed by a light-exposed negative resist;

a second negative resist over and in contact with said plurality of negative resist patterns formed by said light-exposed negative resist and said second electrode layer; and a plurality of positive resist patterns, each being on a respective one of said plurality of lower silicon oxide film patterns.

2. The intermediate product for use in the production of an ink jet recording head as set forth in claim 1, wherein said first electrode layer is platinum and said second electrode layer is aluminum.

3. The intermediate product for use in the production of an ink jet recording head as set forth in claim 1, wherein said first electrode layer is platinum and said second electrode layer is a two-layer film with a titanium film and a gold film formed directly on the titanium film.

4. An intermediate product for use in the production of an ink jet recording head, comprising:

a substrate member comprising a silicon substrate, an upper silicon oxide film, and a plurality of lower silicon oxide film patterns, said upper silicon oxide film being on an upper surface of said silicon substrate, and said plurality of lower silicon oxide film patterns being on said lower surface of said silicon substrate;

a first electrode layer on said upper silicon oxide film;

a piezoelectric film on said first electrode layer;

a second electrode layer on said piezoelectric film, and in contact with said first electrode layer;

a plurality of negative resist patterns, on said second electrode layer, formed by a light-exposed negative resist;

means for preventing electrolytic corrosion of said first electrode layer and said second electrode layer when in the presence of an alkaline aqueous solution; and a plurality of positive resist patterns, each being on a respective one of said plurality of lower silicon oxide film patterns.

5. The intermediate product for use in the production of an ink jet recording head as set forth in claim 4, wherein said means for preventing electrolytic corrosion comprises a second negative resist over and in contact with said plurality of negative resist patterns formed by said light-exposed negative resist and said second electrode layer.

6. The intermediate product for use in the production of an ink jet recording head as set forth in claim 4, wherein said first electrode layer is platinum and said second electrode layer is aluminum.

7. The intermediate product for use in the production of an ink jet recording head as set forth in claim 4, wherein said first electrode layer is platinum and said second electrode layer is a two-layer film with a titanium film and a gold film formed directly on the titanium film.

* * * * *